US005259540A

United States Patent [19]

Kocznar et al.

[11] Patent Number: 5,259,540

[45] Date of Patent: Nov. 9, 1993

[54] DATA CARRIER

[75] Inventors: Wolfram Kocznar, Innsbruck; Kurt Wallerstorfer, Irrsdorf; Gerhard Kiska, Hallein, all of Austria

[73] Assignee: Skidata Computer Gesellschaft M.b.H., St. Leonard, Austria

[21] Appl. No.: 915,786

Related U.S. Application Data

[63] Continuation of Ser. No. 613,807, Feb. 25, 1991, filed as PCT/AT90/00039, Apr. 25, 1990.

[30] Foreign Application Priority Data

Apr. 25, 1989 [AT] Austria ..... 982/89
Apr. 25, 1989 [AT] Austria ..... 983/89
Apr. 25, 1989 [AT] Austria ..... 984/89

[51] Int. Cl.[5] ..... A44C 5/00

[52] U.S. Cl. ..... 224/219; 224/164; 224/165

[58] Field of Search ..... 224/164–166, 224/170, 173, 174, 178, 219, 222, 267; 24/3 A, 70 J, 71 J, 265 B, 265 WS; 40/633; 63/21, 24, 9, 1.1, 2, 3; D10/32, 38, 30; D11/3, 6, 94

[56] References Cited

U.S. PATENT DOCUMENTS

| | | | |
|---|---|---|---|
| 1,151,940 | 8/1915 | Gauvreau | 224/219 |
| 1,632,178 | 6/1927 | Davis | 24/71 J |
| 1,827,243 | 9/1930 | Kuehner | 24/71 J |
| 2,108,892 | 2/1938 | Kestenman | 24/71 J |
| 2,157,076 | 5/1939 | Haeffner | 24/71 J |
| 2,429,950 | 10/1947 | Weber . | |
| 2,471,694 | 5/1949 | Maestri | D10/32 |
| 2,500,649 | 3/1950 | Szeglin | 24/71 J |
| 2,553,676 | 5/1951 | Roos | 224/219 |
| 2,749,634 | 6/1956 | Billett et al. | 224/165 |
| 3,402,808 | 9/1968 | Yannuzzi | 224/219 |
| 3,521,331 | 7/1968 | Gay | 24/71 J |
| 3,521,798 | 7/1970 | Hill | D10/32 |
| 3,550,216 | 12/1970 | Gandelman | 24/71 J |
| 3,555,850 | 1/1971 | Bello | 24/71 J |
| 3,585,744 | 6/1971 | Arnone | 24/71 J |
| 3,631,616 | 1/1972 | Hill | 40/633 |
| 3,636,596 | 1/1972 | Iizuka | 24/71 J |
| 3,685,107 | 8/1972 | Epiard | 24/265 WS |
| 3,769,726 | 11/1973 | Spence . | |
| 4,183,986 | 1/1980 | Blaetterlein | 224/178 |
| 4,197,968 | 4/1980 | Ullman et al. | 224/178 |
| 4,330,905 | 5/1982 | Wolfgang | 24/71 J |
| 4,424,611 | 1/1984 | Mori | 24/265 WS |
| 4,542,561 | 9/1985 | Hysek | 24/71 J |
| 4,546,522 | 10/1985 | Gygax | 24/265 WS |
| 4,708,492 | 11/1987 | Mock et al. | 224/164 |
| 4,770,008 | 9/1988 | Yamaura | 63/3 |

FOREIGN PATENT DOCUMENTS

| | | | |
|---|---|---|---|
| 0018018 | 10/1980 | European Pat. Off. | 24/71 J |
| 0038793 | 4/1981 | European Pat. Off. . | |
| 0077418 | 4/1983 | European Pat. Off. . | |
| 8526887 | 12/1985 | Fed. Rep. of Germany . | |
| 8602775 | 5/1986 | Fed. Rep. of Germany . | |
| 8506458 | 8/1986 | Fed. Rep. of Germany . | |
| 851181 | 9/1939 | France . | |
| 965823 | 9/1950 | France . | |
| 1272870 | 8/1961 | France . | |
| 1543487 | 10/1968 | France . | |
| 1591988 | 5/1970 | France . | |
| 2601864 | 1/1988 | France . | |
| 8605077 | 9/1986 | PCT Int'l Appl. . | |
| 244409 | 9/1946 | Switzerland | 24/71 J |
| 651729 | 10/1985 | Switzerland . | |
| 113057 | 2/1918 | United Kingdom . | |
| 1046406 | 10/1966 | United Kingdom . | |
| 2160492 | 6/1984 | United Kingdom . | |

OTHER PUBLICATIONS

Dugena Watch Publication Jan. 1986.

*Primary Examiner*—Henry J. Recla
*Assistant Examiner*—David J. Walczak
*Attorney, Agent, or Firm*—Lorusso & Loud

[57] ABSTRACT

To permit visual monitoring of the owner of a data carrier in the form of a wrist-watch, a photo of the owner is incorporated in the clasp attached to the strap of the data carrier.

13 Claims, 4 Drawing Sheets

DATA CARRIER

Figure 1:
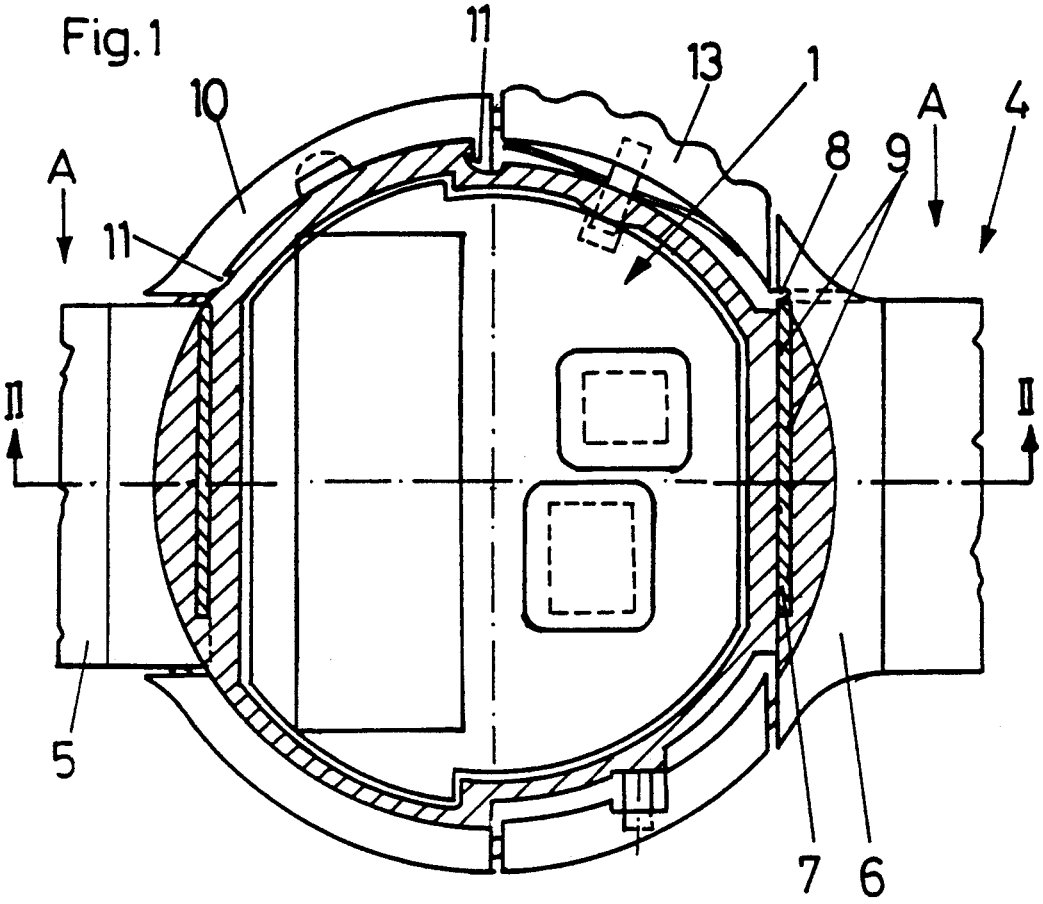

This is a continuation of copending application Ser. No. 07/613,807 filed on Feb. 25, 1991 which is based on International Application PCT/AT90/0039 filed on Apr. 25, 1990 and which designated the U.S.

The invention concerns a data carrier like a wristwatch with a case, in which there is a picture of the bearer on the data carrier.

This type of data carrier can be inferred, for example, from WO-A-88/03296, and is used particularly for transportation tickets, credit cards, ski passes, etc., with a rather long validity period and multiple user rights. In order to prevent unauthorized use of such a data carrier by several persons, the case of the data carrier contains a photo of the authorized bearer, which can be glued in under a transparent cover.

The arrangement of the bearer photo in the case of a wristwatch-type case can lead to problems in inserting and recognizing the photo because of the limited space and can cause further problems since the bearer may not want to wear his own picture on the arm in an obvious way.

The purpose of the invention is therefore to create a data carrier of the type mentioned above in which these problems are eliminated, at least for the most part.

According to the invention, this is achieved by having the picture in a holder connected to the wristband of the data carrier.

A holder that goes with the wristband can now be adapted to hold the picture of the bearer of the data-carrier in a way that is significantly better than in the case itself, since the case must be coordinated with the receiving and reproducing of the data, as well as with diverse use of the data carrier. This way, the picture is not on the outside of the arm visible to everyone in an obvious way, but can be seen only when the arm is consciously turned. This is especially true if the wristband has two parts, and the holder represents the base of the clasp, which is attached to part of the wristband.

In another version of the invention, where the wristband has two parts the picture holder is designed as a loop, through which the part of the wristband firmly attached to the clasp goes, the picture can be taken out of the obvious field of vision on the outside of the arm.

Having the picture in a holder away from the case then requires the safest form of attachment to the case, i.e., the wristband must meet basic criteria for attachment to the case and durability and resistance to the effects of weather. If the holder is on the clasp, the clasp must be attached to the wristband according to the same criteria.

One preferred version of the data carrier, which meets these criteria, is conceived so that the base of the clasp is designed as the first flap of a foldover buckle, whose third flap is connected to the second part of the wristband. By using a foldover buckle, the data carrier can be loose on the arm, but does not fall off unnoticed, since it must be strapped over the hand.

In order to be able to adjust the length of the wristband around the wrist of the bearer, or to be able to have the data carrier both under the clothing or over (for example, wearing it over a ski jacket), a second preferred version can be provided whereby the attachment end on the clasp side of at least one of the two parts of the wristband has at least two attachments spaced apart to attach it to the clasp.

In this way, the clasp can be arranged opposite the data carrier approximately in the center, despite the optional length of the wristband, when the attaching end of the first part of the wristband attached to the base of the clasp has at least two areas, one of which has a hole for attaching, wherein one area can be cut off, and a pin placed in the side pieces of the clasp goes through the outermost hole. In order to make the second part of the wristband also adjustable to different lengths, another preferred version is conceived wherein the third flap of the foldover buckle has a row of studs and the attaching end of the second part of the wristband on the clasp side has a row of holes, and the number of holes is larger by at least one than the number of studs. The second part of the band can thus be fixed to the third flap of the foldover buckle in at least two positions. The attachment can be relatively hard to loosen, since all you have to do to take the data carrier off the wrist is open the foldover buckle. Preferably, on the free end of the third flap, there is an insert loop designed for attaching the end on the clasp side, wherein the stud next to the loop is cylindrical and the other studs are mushroom-shaped knobs.

The attachment between the clasp holding the picture and the first part of the wristband should correspond to the above-mentioned criteria, and may also be difficult to separate or may be separated only by damaging or destroying it. This can be achieved, for example, by arranging the pin in eyelets in the side pieces that are covered on the outside. At least one eyelet can thus be designed as a hole going through the side pieces, so that the pin can be pushed in from outside the first time the wristband is fitted to the bearer. Then, to make the first part of the wristband with the pin attached to the clasp inaccessible, another preferred version provides for at least one eyelet to be closed by a covering cap. The covering cap can thus be sealed, glued or the like.

The base of the clasp designed as a picture holder can have a viewing window, to which the picture is adhered on the inside. If the foldover buckle is closed, then the picture will be covered by the second, jointed flap of the foldover buckle.

The clasp described here with a foldover buckle in which both parts of a wristband can be adjusted optionally at least the first time they are put on, and in which part of the wristband can also be adjusted later in various positions, can be used not only on data carriers that have a wristband of the type mentioned at the beginning in the form of owner-specific credit cards, ski passes or the like, but can also be used for other bands, especially wristbands, regular wristwatches, jewelry worn on a wristband, etc., wherein the clasp can also be used without a picture in it in these cases of application.

The attachment between the wristband and the case of the data carrier should also correspond to the criteria listed above to rule out any possible manipulation. It is therefore preferably provided in another version that each end of the wristband that is attached to the case side have two extensions protruding on the facing wide sides, that the case have a matching retaining opening on the attaching end, and that each retaining opening, into which the part of the wristband with the picture is placed, have a locking forming an integral part of the case. Directly attaching the wristband, which may be one-piece, to the case offers a series of advantages over conventional wristband fasteners for watches, along with an esthetically pleasing appearance. And special aids, like tools or adhesives, for example, are unnecessary, since both ends of the wristband can be pushed, inserted or forced into the retaining opening, wherein the extension laterally protruding in the longitudinal direction of the wristband provides a form closure. The locking part covering the retaining opening can be attached to the case so that it can be opened only by destroying the locking part, and unauthorized changing of the wristband is prevented.

If each extension is formed by one bar, then the ends of the wristband are about in the central plane of the case. If the data carrier has a circular case, as in another version, each retaining opening is formed by a slot that is T-shaped in cross section, closed on one end and open to the circumference of the case on the second end. In this way, the ends of the wristband, which are equipped with protruding bars on both sides, can be pushed simply from the circumference of the case to the stop. In order to make it more difficult to push out one of the inserted ends again, friction-enhancing locking elements can be provided in the slot in the push-out direction. The locking elements can, for example, be formed by inclined protruding teeth or the like, which press into the end of the wristband.

One preferred version also includes as a locking part for the retaining opening a ring section that locks around the circumference of the case. The ring section can, for example, have press-in stops in corresponding back cuts, so that it can be pressed on after the end of the wristband is inserted. It would also be possible to join the ring section on one side to the case, so that it is attached to it and cannot be lost. Furthermore, the locking part or the ring section could conceivably be formed by a control button for the data carrier, which is mounted after the end of the wristband is inserted.

In another version, the retaining opening is not open to the circumference, but is accessible only after the base of the case is removed. In this version, then, the base of the case serves simultaneously as a locking part of both retaining openings. Specifically, a removable base can be provided when the data carrier contains a power -cell that must be changed.

As mentioned, the wristband used with the data carrier mentioned should be capable of being subjected to the most varied, often quickly changing environmental conditions, and also should be easy to adjust and comfortable to wear, as well as look nice.

The wristband is therefore specifically constructed of at least two layers, one of which forms a carrier body and a second a cover layer. At least one other layer may be provided between them. In one initial preferred version, it is provided that the carrier body be composed of a network polymer that is gentle on the skin and is cast on the layer lying over it.

The wristbands can be manufactured simply and quickly in casting molds by inserting the layer on which the polymer will be cast. The manufacturing process indeed provides for a film, that may be a multilayered one, forming the upper layer to be inserted in a cavity die, then a free-flowing polymer that is gentle to the skin to be poured into the cavity die and next a top flask to be lowered and the polymer to be cross linked by heat and/or pressure. Simultaneous manufacture of several wristbands is significantly simplified if the cavity die has several chambers and the top flask has several chambers which can be lowered onto the cavity die, wherein the separating bars bordering the chambers are built like cutters. The layer covering all of the chambers, which may be multilayered, is placed on the cavity die and the free-flowing polymer is poured on. After the top flask is lowered, the individual chambers are closed as hollow spaces, wherein the separating cutter bars divide the contents of the mold into several strips composing the wristbands.

From the large number of cross-linked polymers that are gentle to the skin, a cross-linked elastomer in particular, preferably a caoutchone is selected. Since the elastic properties of the polymer are not very significant, other free-flowing polymers that are comfortable to wear can be used, for example, cross-linked silicon, silicon rubber, chlorosulfonated polyethylene or the like.

Another version provides that the carrier body be poured onto a printed carrier layer, which is covered with a transparent cover layer. In this way, the wristband can also be designed to take into account esthetic, fashion or commercial considerations.

Especially when used as a ski pass, the wristband is subject to strong ultraviolet radiation, which the cover layer must resist without becoming brittle or breaking, since it cannot be changed during use. For this reason, the cover layer may also consist of a transparent polyethylene film, especially a high-pressure polyethylene film.

By making the cover layer out of polyethylene foil, whose properties are known not to change under extreme temperatures, a wristband is made that is appropriate in the peculiar areas of application specific to data carriers, and need not be changed during the life of the data carrier.

The cover layer can thus not only be arranged on the printed carrier layer, but can in a different version be printed like a mirror image on the side facing the carrier body, wherein especially the printed side of the cover layer has a colored cover. If a printed carrier layer is used between the cover layer and the carrier body, then preferably the printed carrier layer consists of a polyethylene film, especially a high-pressure polyethylene film.

Such wristbands are suitable especially, but not exclusively for use with the data carriers in the WO-A-88/03296 specified at the beginning. Since the life of the wristband at least corresponds to that of the data carrier, as already mentioned, the picture or even other bearer-related data on the wristband itself, can be placed under the transparent cover layer, on an additional loop or the like placed on the wristband, or on the wristband clasp. Of course, such a wristband can also be fastened to conventional wristwatches.

The invention will now be described in greater detail below using the figures on the enclosed drawings, but is not limited to them.

Figure 2:
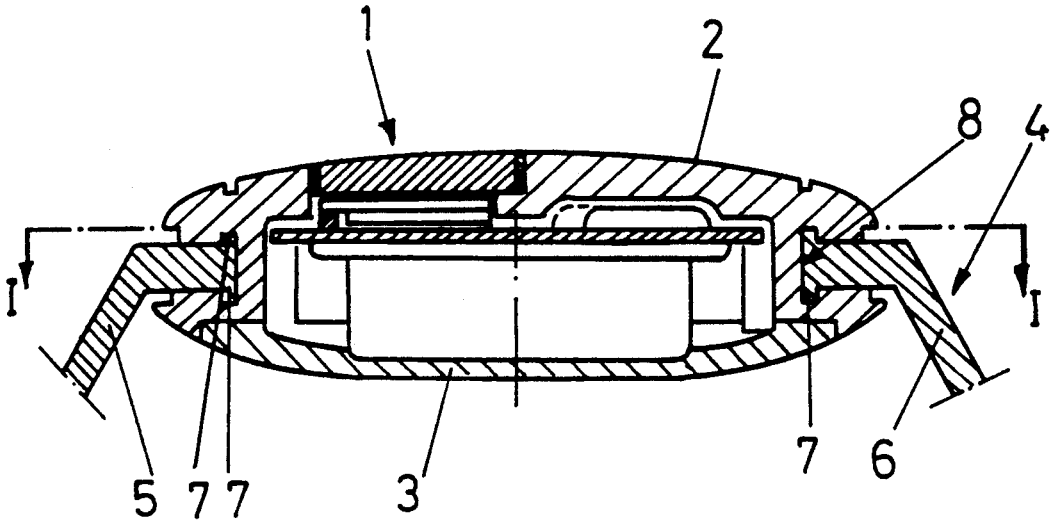
Figure 3:
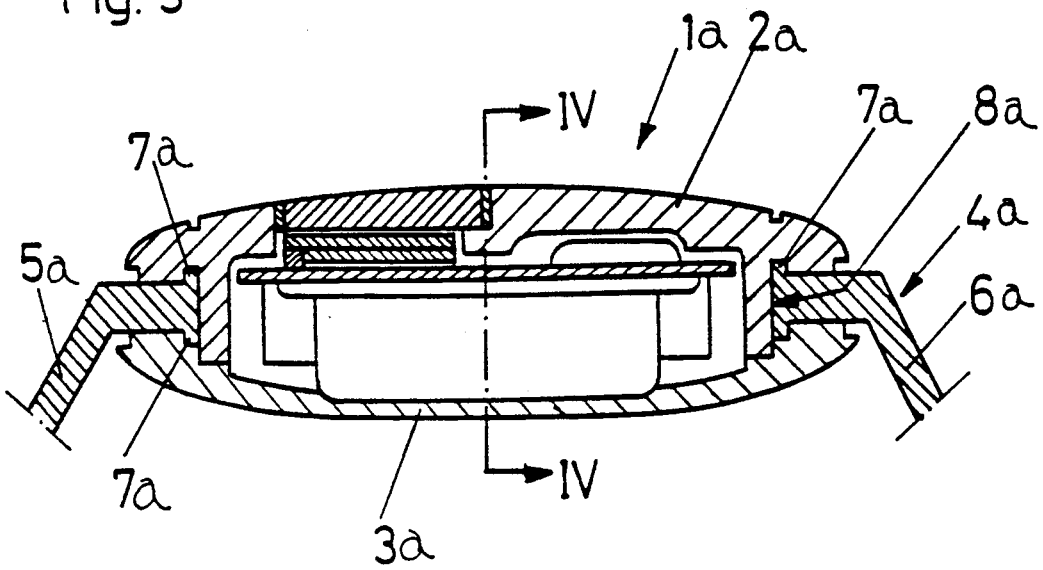
Figure 4:
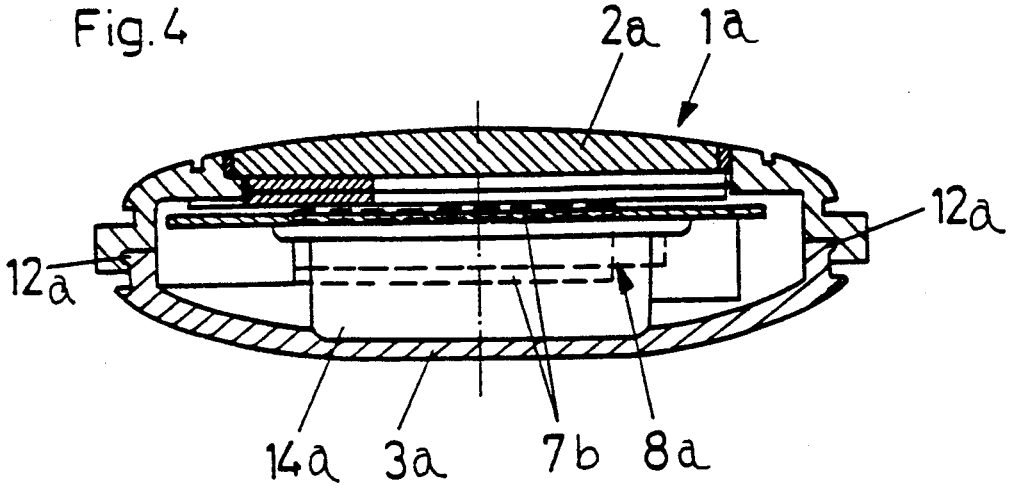
Figure 5:
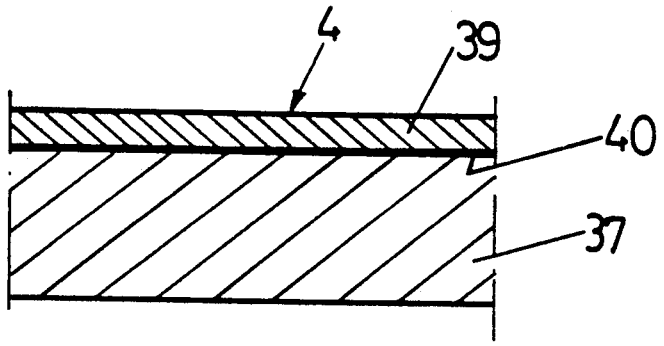
Figure 6:
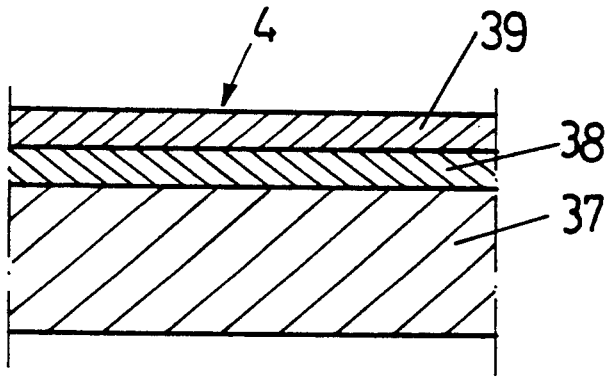
Figure 7:
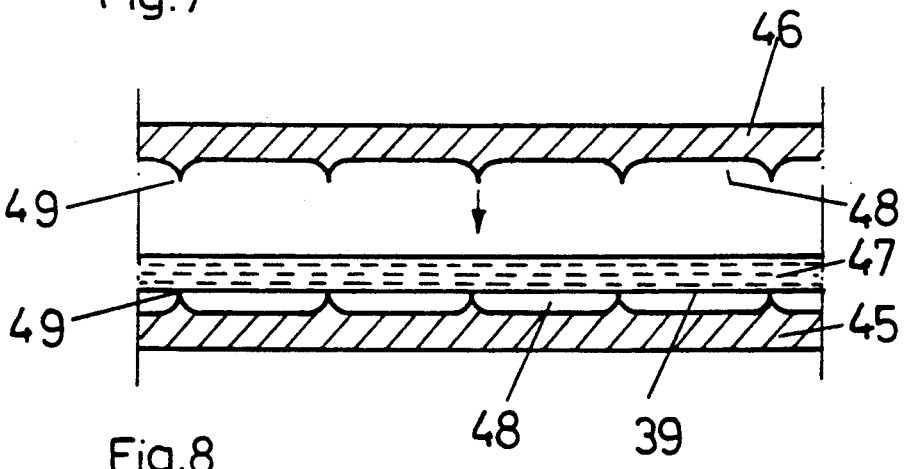
Figure 8:
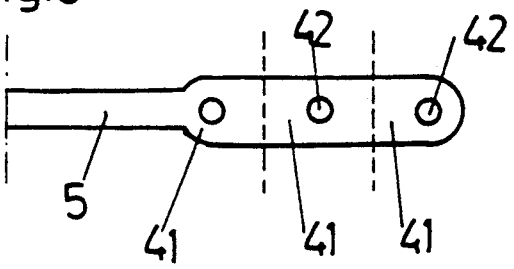
Figure 9:
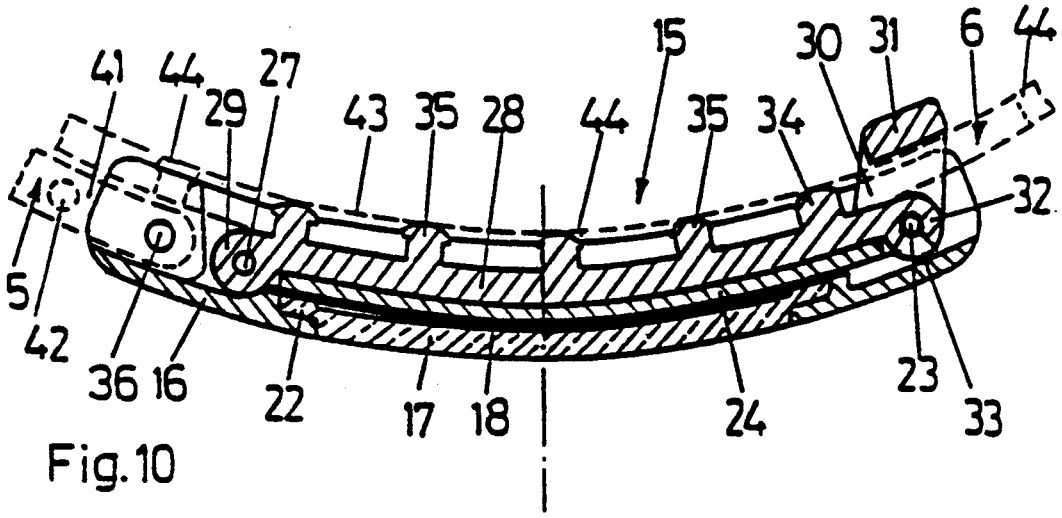
Figure 10:
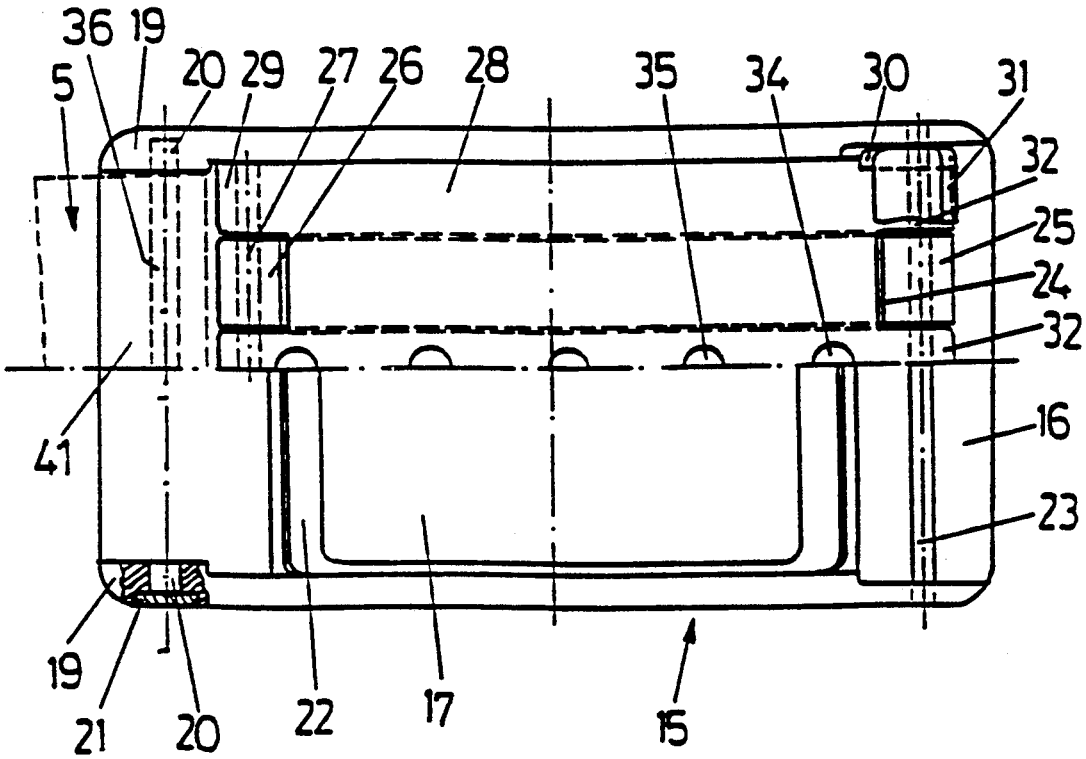
Figure 11:
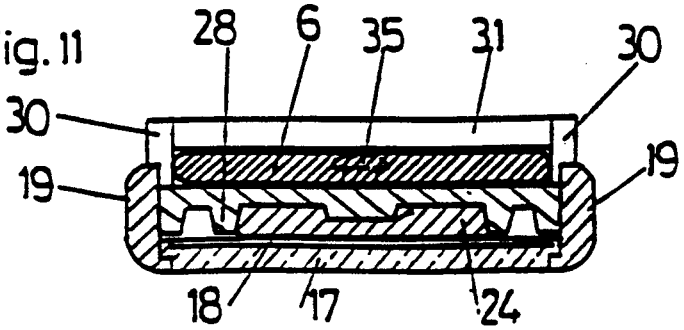

They show:

FIG. 1 a horizontal section through a data carrier along line I—I of FIG. 2, FIG. 2 a vertical section through the data carrier along line II—II in FIG. 1, FIG. 3 a section like FIG. 2 through a second version of a data carrier, FIG. 4 a section along line IV—IV of FIG. 3, FIG. 5 and 6 the layer construction of a wristband in two different examples of execution, FIG. 7 the manufacture of a wristband according to FIG. 5 schematically, FIG. 8 the end of a first part of the wristband which can be firmly attached to the clasp according to FIGS. 9 to 11, FIG. 9 a clasp in longitudinal section, FIG. 10 the clasp in a sectional top view from the inside, and FIG. 11 the clasp in cross section.

A data carrier in the form of a wristwatch has a round case 1, which includes a cover 2 and a base 3, and in which electronic components not essential for this invention, including a display in the cover 2, are provided. On the case 1 there is a wristband 4, so that the data carrier can be worn on the wrist. Both ends of the wristband 4, which may be one-piece or two-piece, are shown; on both wide sides, they have a projecting extension 7, which is designed in the form of a bar extending over the larger part of the wide side. In the longitudinal section therefore the ends of the wristband 4 or of its two parts 5,6 appear T-shaped (FIG. 2,3), and diametrically opposed retaining openings 8 for inserting both ends in the case 1 are provided which are formed by a slot which is also T-shaped. At least the areas of each retaining opening 8 where the extensions 7 are inserted are, as shown cross-hatched in FIG. 4, terminating at a certain length within the cover member 2, so that in the version in FIGS. 1 and 2, the ends can be pushed from the mouth of the retaining opening 8 on the periphery of the case 1 up to the stop (arrow A, FIG. 1). This effects a closure in the longitudinal direction of the wristband. In the push-out direction, which is in the opposite direction of A, the retaining openings 8 can have friction-enhancing locking elements 9, for example diagonal teeth or the like, which press into the respective ends of the wristband 4 or its two parts 5,6. Thus, preventing disengagement of parts 5,6 is carried out by employing the opening 8 to receive the T-shaped extensions 7 which effects a tension-proof connection.

For covering, at least of one of the retaining openings 8, there is a locking part that can be attached to the case 1 and is preferably destroyed when removed. In the version in FIGS. 1 and 2, the locking part is made up of a ring section 10, which fits with stops 11 into corresponding indents on the edge of the case 1. The locking part can also consist of a control button 13, which in this case, as shown cross-hatched above right in FIG. 1, extends over the mouth of the retaining opening on the edge of the case and is mounted after the end of the wristband is inserted. Opening 8 is therefore covered by ring section 10 and control button 13. Control button 13 serves to operate electronic parts within the housing, and is also useful for the data display. It is movably held at the ring section 10, and the ring section 10 is snapped into the case 1.

In the version in FIGS. 3 and 4, the retaining openings 8 are not accessible from the periphery of the case, but only after the base 3' is removed. The base has a peripheral stop 12', which can be locked into a corresponding groove inside the cover 2'. The ends of the wristband again also have bar-type extensions, so that the retaining openings 8' are composed of T-shaped slots. If the power cell 14' must be changed via the removable base 3', then the removable base 3 simultaneously forms the locking part for both retaining openings 8', wherein unauthorized removal of the base 3' preferably leads to the probable destruction of electronic data due to the inoperability of electronic parts in the absence of base 3, in this version as well.

The ends of the wristband can also be designed in another way to effect a form closure with the case 1', for example, by designing a round bead or the like. And also several extensions 7' recommended for effecting the form closure can be arranged one behind the other, so that the wristband can be cut to the right length. The wristband in an initial version, as can be seen in the longitudinal section in FIG. 5, has a carrier body 37 and a cover layer 39. The carrier body 37 consists specifically of a cross-linked polymer that is gentle to the skin, preferably made out of rubber, which is poured on the cover layer 39. The cover layer 39 consists of a transparent polyethylene film, especially a high-pressure polyethylene film, which is printed like a mirror image on the side facing the carrier body 37. For better color design, the printed under side of the cover layer has a color covering 40, so that the carrier body 37 is not visible from above.

According to FIG. 6, there is a printed carrier layer 38 on the carrier body 37, especially one made of rubber, which consists of an opaque polyethylene film, specifically a high-pressure polyethylene film and can be printed in any way desired. Over it is a cover layer 39 made out of a transparent polyethylene film.

Manufacture of the wristbands 4 or their two parts 5,6 is carried out in a casting mold, which is shown open in FIG. 7. This casting mold shown is used for simultaneous manufacture of several wristbands next to one another and consists of a cavity die 45 with chambers 48, as well as a top flask that also has chambers 48 that can be lowered. Between the chambers 48 are separating cutter bars 49. The cover layer 39 with the side on top that may be printed, or the pair of layers 38, 39 with the printed carrier film 38 lying on top are placed on the cavity die. Next, a latex mixture 47 is poured over it and the top flask 46 is lowered in the direction of the arrow. By using heat and pressure, the latex mixture in the chambers 48 is cross-linked, wherein the separating bars 49 press together and divide the corresponding strips into wristbands 4. The manufactured wristbands can also be used for long periods of time under extreme temperatures and weather conditions because of the polyethylene film used and are therefore suitable primarily for attaching to data carriers.

The picture of the owner is preferably placed in the clasp 15, which is shown in detail in FIGS. 9 to 11. The clasp 15 has a curved base 16, on which there is a side piece 19 on each side, so that the base of the clasp 15 is designed to have a concave shape. In the base 16, there is a recess with an inner gradation 22, in which a viewing window 17 is inserted. The window 17 has an indentation on the inside in which the picture 18 is glued. The base 16 of the clasp 15 forms the first flap of a three-piece foldover buckle and has only eyelet 20 each to fasten the first part 5 of the wristband 4 to both side pieces 19, in which a pin 36 can be inserted. The end 41 of the first part 5 of the wristband 4 has areas, as seen FIG. 8, for adjusting the length, each of which has a hole 42 in it. As shown by the cross-hatched lines, two areas, having a length of about 5 to 6 mm, respectively, can be cut so that shortening by 10 to 12 mm is possible. To fasten the ends 41, the pin 36 is pushed through the eyelet 20, that goes through the side pieces 19 and is shown as the lower one in FIG. 10, and through the hole 42 of the end of the wristband.

The accessible outer side of the eyelet 20 is closed by a covering cap 21 that can be hooked or glued in. The second eyelet 20 is designed as a sack hole and is therefore inaccessible from the outside. On the side opposite the eyelets 20 there is an axle 23 in the side pieces 19, in which the second flap 24 of the foldover buckle is mounted. This has hinged elements 25 which are shaped like teeth, which engage the eyelets 20 through which axles 23 extends. At the other end of the flap 24, there is a second axle 27, and hinged elements 26 also shaped like teeth, on which the third flap 28 of the foldover buckle is mounted. The third flap 28 also has hinged elements 29 shaped like teeth, which go between the hinged elements 26, wherein, as can be seen from FIG. 11, both flaps 24 and 28 in a closed position have longitudinal pins and grooves that fit together. On the third flap 28, in the area of the axle 23, attached to the base, there are hinge-like stops 32, which are semi-cylindrical and thus have an open slot 33 underneath, so as to form a catch between the hinge elements 25 when snapped on the axle 23, so that the foldover buckle is releasably attached in the position shown. On the side of the stops 32, the third flap 28 has high side bars 30, which are connected via a hoop 31, forming a loop for inserting the end 43 of the second part 6 of the wristband 4 shown in cross-hatching in FIG. 9. From the third flap 28, studs 34,35 rise up, and the stud 34 next to the hoop 31 is cylindrical and the others are mushroom-shaped. At the end 43 of the wristband part 6, there are holes into which the studs 34,35 can be snapped. Since the number of holes 44 is larger than the number of the studs, the length of the second part 6 of the wristband 4 can be varied the first time it is fitted to the owner of the data carrier. Later alterations are unnecessary, since the foldover buckle opens wide enough to be able to take the data carrier off the wrist.

Instead of the clasp 15, the picture 18 of the owner could also be put on a slip-on loop before the base 16 is mounted on the first part 5 of the wristband. Because of the design of the connection between the case 1 and the wristband 4 in its first part 5, it is practically impossible to change the wristband without the wristband being recognized. as doing so would change the picture 18 or other owner-related data. If the data carrier has a serial number, then it can also be on the clasp 15. The material for the clasp 15 can be an appropriate synthetic material.

We claim:

1. A data carrier providing a user right to an authorized owner and to be worn on the wrist comprising:

a case containing electronic components for receiving and reproducing owner-specific data;

a three-flap foldover buckle having a first flap, a second flap and a third flap, said first flap and said second flap being connected by a first hinge axle and, said second flap and said third flap being connected by a second hinge axle, said first flap having an inner side adapted to face the wrist of the owner and an outer side adapted to face away from the wrist of the owner, said inner side being adjacent and said outer side being opposite said second flap when the buckle is folded, said first flap comprising a transparent viewing window, said third flap having an inner side adapted to face the wrist of the owner, and an outer side adapted to face away from the wrist of the owner, said third flap having studs on said inner side thereof;

a wristband having a first and a second part, said first part being connected to said case and to said first flap, and said second part being connected to said case and to said inner side of said third flap, said second part having holes therein, said holes being adapted to receive said studs wherein the number of said holes is larger than the number of said studs such that the mating of said studs with said holes provides a wristband of variable length; and a picture of the owner of said data carrier, said picture being fixed to said inner side of said first flap, and said picture being damaged when removed from said data carrier.

2. A data carrier according to claim 1, wherein said first flap, said second flap and said third flap are made from a plastics material.

3. A data carrier according to claim 1, wherein said third flap and said second flap have longitudinally reinforcing ribs and grooves alternately engaging in one another when said buckle is folded.

4. A data carrier according to claim 1, wherein said third flap comprises at least one inwardly extending stop to be locked at said hinge axle between said second flap and said first flap.

5. A data carrier according to claim 1, wherein, when the buckle is folded, said first flap has a part extending beyond the hinge axle between said second flap and said third flap, and wherein said first part of said wristband is connected to a fastening means provided at said inner side of said extending part of said first flap.

6. A data carrier according to claim 1, further comprising an insertion loop on said outside of said third flap.

7. A data carrier according to claim 1, wherein at least one of said studs is shaped like a mushroom.

8. A data carrier according to claim 1, wherein the stud next to said loop is cylindrical and the other studs are shaped like mushrooms.

9. A three-flap foldover buckle for a wrist band comprising:

a first flap, a second flap and a third flap, said first flap, and said second flap being connected by a first hinge axle and said second flap and said third flap being connected by a second hinge axle, said first flap and said third flap, each, having an inner side adapted to face a wearer's wrist and an outer side adapted to face away from a wearer's wrist, said inner side of said first flap and said outer side of said third flap being adjacent said second flap when said buckle is folded;

a first band fastening means arranged on said first flap, comprising an eyelet adapted to receive a pin;

a second band fastening means arranged on said inner side of said third flap comprising studs adapted to selectively engage holes in said band for selectively fastening said band in at least two positions, said third flap having an insertion loop on said outer side and at least one inwardly extending snap-in stop on said inner side, said snap-in-stop catching said hinge axle between said second flap and said first flap.

10. The buckle according to claim 9, wherein said third flap and said second flap have longitudinally reinforcing ribs and grooves alternatively engaging in one another when said buckle is folded.

11. A buckle according to claim 9, wherein, when the buckle is folded, said first flap has a part extending beyond said hinge axle between said second flap and said third flap and having an inner side, said inner side of said extending part being provided with said first band fastening means.

12. The three-flap foldover buckle according to claim 9, wherein at least one of said studs is shaped like a mushroom.

13. The three-flap foldover buckle according to claim 9, wherein a stud next to said insertion loop is cylindrical and the other studs are shaped like mushrooms.

* * * * *